United States Patent [19]

Morita et al.

[11] 4,376,150

[45] Mar. 8, 1983

[54] HEAT-SENSITIVE RECORD MATERIAL

[75] Inventors: Munetaka Morita, Hyogo; Takuji Tuji, Osaka; Katsuhiko Ishida, Hyogo, all of Japan

[73] Assignee: Kanzaki Paper Manufacturing Co., Ltd., Tokyo, Japan

[21] Appl. No.: 265,238

[22] Filed: May 19, 1981

[30] Foreign Application Priority Data

May 23, 1980 [JP] Japan ..... 55-69159

[51] Int. Cl.[3] ..... B41M 5/18

[52] U.S. Cl. ..... 428/320.4; 282/27.5; 427/150; 427/151; 428/320.8; 428/488; 428/537; 428/913; 428/914

[58] Field of Search ..... 282/27.5; 427/150, 151, 427/152, 153; 428/320.8, 411, 488, 530, 531, 537, 913, 914, 320.4, 320.6, 323

[56] References Cited

FOREIGN PATENT DOCUMENTS

| | | | |
|---|---|---|---|
| 43-4160 | 2/1968 | Japan | 282/27.5 |
| 45-14531 | 12/1970 | Japan | 282/27.5 |
| 46-19231 | 7/1971 | Japan | 282/27.5 |

*Primary Examiner*—Bruce H. Hess

*Attorney, Agent, or Firm*—Morgan, Finnegan, Pine, Foley & Lee

[57] ABSTRACT

In a heat-sensitive record material comprising a base sheet having a color developing layer which includes finely divided particles of colorless chromogenic material and finely divided particles of acceptor, the colorless chromogenic material exists in the color developing layer in an amorphous state.

4 Claims, No Drawings

HEAT-SENSITIVE RECORD MATERIAL

BACKGROUND OF THE INVENTION

This invention relates to a heat-sensitive record material and particularly to a heat-sensitive record material which has a remarkably improved heat-sensitivity and is adapted for a high speed recording so that it may find its usefulness as a recording medium for information machines and instruments such as facsimiles, electronic computers and telex machines.

There is known a heat-sensitive record material comprising a base sheet having a color developing layer which includes finely divided particles of one of colorless chromogenic materials such as triphenylmethane compounds, fluoran compounds, auramine compounds and spiropyran compounds and finely divided particles of one of organic acceptors such as phenolic compounds, aromatic carboxylic acids and their polyvalent metal salt and/or one of inorganic acceptors such as activated clay, acid clay, attapulgite, aluminum silicate and talc. In such the heat sensitive record material like this the above mentioned two kinds of particles are, when at least one of them is melted or sublimated at an elevated temperature, brought into intimate contact with each other to develop a color. Accordingly, a relatively high temperature is required for obtaining clear and distinct color images. This is apparently disadvantageous since clear and distinct color images can never be expected at a high speed recording.

With an attempt to avoid the above mentioned disadvantages is has been proposed to disperse in the color developing layer a heat fusible material which can when melted, dissolve at least one of the colorless chromogenic material and the acceptor therein, e.g., as disclosed Japanese Patent Publication No. 4160 of 1968 and Japanese Kokai (Laid-Open) Patent Publication No. 19,231 of 1973. In this manner the heat sensitivity at low temperatures is improved. This improved system is useful for obtaining clear and distinct images if time for heating is relatively long as in case of the infrared copying. This system is not however utilizable for a high speed recording with such an extremely short heating time as 1 to 4 milliseconds which are required in high speed facsimiles since color can never be developed enough.

The primary object of the invention is to provide an remarkably improved heat-sensitive record material which can avoid the above mentioned disadvantages inherent with the conventional systems and can satisfactorily meet the requirements of recording machines and implements in which recording is carried out at a high speed and with a high image density.

Another object of the invention is to provide an improved heat-sensitive record material which is immediately heat responsive.

Other objects and advantages of the invention will be apparent from the following detailed description.

SUMMARY OF THE INVENTION

The heat-sensitive record material according to the invention comprises a base sheet having a color developing layer which includes finely divided particles comprising colorless chromogenic material and finely divided particles comprising acceptor which is reactive with the colorless chromogenic material to develop a color, the colorless chromogenic material existing in said color developing layer in an amorphous state. The colorless chromogenic material in an amorphous state may be obtained by heating at least one kind of colorless chromogenic material in a crystalline state to form a melt and then cooling said melt.

Preferably, the colorless chromogenic material in an amorphous state may be obtained by heating at two or more kinds of colorless chromogenic materials, at least one of which is of a crystalline state, to form a co-melt and then cooling said co-melt. In another preferred embodiment of the invention, the colorless chromogenic material in an amorphous state is obtained by heating at least one kind of colorless chromogenic material in a crystalline state together with at least one organic compound, which is compatible with said colorless chromogenic material, to form a co-melt and then cooling said co-melt. The organic compound may be a solvent which takes a liquid phase at a normal temperature and is capable of dissolving the colorless chromogenic material in a crystalline state therein when heated.

DETAILED DESCRIPTION OF THE INVENTION

Any of various known colorless chromogenic materials may be used for the present invention. Among them there are included, by way of examples, 3,3-bis(p-dimethylaminophenyl)-6-dimethylaminophthalide (CVL), 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3,3-bis-(1,2-dimethylindole-3-yl)-5-dimethylaminophthalide, 3,3-bis-(1,2-dimethylindole-3-yl)-6-dimethylaminophthalide, 3,3-bis-(9-ethylcarbazole-3-yl)-5-dimethylaminophthalide, 3,3-bis-(2-phenylindole-3-yl)-5-dimethylaminophthalide, 3-p-dimethylaminophenyl-3-(1-methylpyrrole-2-yl)-6-dimethylaminophthalide, 4,4'-bis-dimethylaminobenzhydrylebenzylether, N-halophenyl-leucoauramine, N-2,4,5-trichlorophenyl-leucoauramine, rhodamine-B-anilinolactam, rhodamine-(p-nitroanilino)lactam, rhodamine-(p-chloroanilino)lactam, 3-diethylamino-7-methoxyfluoran, 3-diethylamino-7-chlorofluoran, 3-diethylamino-(7-acetylmethylamino)fluoran, 3-diethylamino-(7-methylamino)fluoran, 3,7-diethylaminofluoran, 3-diethylamino-7-(dibenzylamino)fluoran, 3-diethylamino-7-(methylbenzylamino)fluoran, 3-diethylamino-7-(O-chloroanilino)fluoran, 3-(N-cyclohexyl-N-methylamino)-6-methyl-7-phenylaminofluoran, 3-diethylamino-7-(chloroethylmethylamino)fluoran, 3-diethylamino-7-(diethylamino)fluoran, 2-phenylamino-3-methyl-6-(N-ethyl-N-p-toluidino)fluoran, benzoylleuco-methyleneblue, p-nitrobenzyl-leucomethylene blue, 3-methyl-spiro-dinaphthopyrane, 3-ethyl-spiro-dinaphthopyrane, 3,3'-dichloro-spiro-dinaphthopyrane, 3-benzylspiro-dinaphthopyrane, 3-methyl-naphtho-(3-methoxy-benzo)-spiropyrane and 3-propyl-spirodibenzopyrane. The above colorless chromogenic materials may be used either solely or in combination.

Each of the above mentioned colorless chromogenic materials is a crystalline compound having a sharp melting point and exhibits its own inherent diffraction image when observed by X-ray analysis.

According to the invention, the colorless chromogenic compound of the kind described in the above is used in an amorphous state in the color developing layer in order to remarkably improve the heat-sensitivity of the record material.

The colorless chromogenic material in a stable amorphous state can be obtained by heating at least one kind of colorless chromogenic material in a crystalline state to form a melt and then cooling the melt. The utilization of two or more kinds of colorless chromogenic materials is preferred because the melting point for obtaining a co-melt can be reduced.

In another preferred embodiment of the invention, the colorless chromogenic material in an amorphous state may be obtained by heating at least one kind of colorless chromogenic material in a crystalline state together with at least one organic compound, which is compatible with said colorless chromogenic material to form a co-melt and then cooling said co-melt. The organic compound of the kind described may be a solvent which takes a liquid phase at a normal temperature and capable of dissolving the colorless chromogenic material in a crystalline state therein when heated. Among those organic compounds which can be used together with the colorless chromogenic material in a crystalline state, there are included various kinds of oils such as alkylnaphthalene, diarylalkane, alkylbiphenyl, hydrogenated terphenyl, triarylmethane, phenylene-oxide, alkylbenzene, benzylnaphthalene, diaryl alkylene and the like, for example, arylindane.

The amount of the above mentioned organic compound to be added may be determined in consideration of the stability of the colorless chromogenic material in an amorphous state obtained. Usually, the amount of the organic compound added may be within the range of 50 parts by weight or less with respect to 100 parts by weight of the colorless chromogenic material. It is also possible to control the temperature-viscosity characteristic of the colorless chromogenic material in an amorphous state obtained depending on the properties and the amount of the compound added. Accordingly, it is possible to obtain such a colorless chromogenic material in an amorphous state that a co-melt having a viscosity low enough for dispersion may be produced at a temperature condition proper for dispersing the colorless chromogenic material into water, whereby a water dispersion of the colorless chromogenic material can be prepared as a liquid-liquid dispersion system.

The colorless chromogenic material in an amorphous state exhibits no substantial peak of X-ray diffraction image. This can be easily observed by X-ray diffraction analysis.

The acceptor as the other reactant of the heat-sensitive record material according to the invention may be either organic or inorganic.

Among organic acceptors there are included phenolic compounds, aromatic carboxylic acids and their polyvalent metal salt. Especially, phenolic compounds are preferred because they are superior in color developing ability.

Typical phenolic compounds which can be used as acceptor are: 4-tert-butylphenol, 4-hydroxydiphenoxide, α-naphthol, β-naphthol, 4-hydroxyacetophenol, 4-tert-octylcatechol, 2,2'-dihydroxydiphenol, 2,2'-methylene-bis(4-methyl-6-tertisobutylphenol), 4,4'-isopropylidene-bis-(2-tert-butylphenol), 4,4'-sec-butylidenediphenol, 4-phenyphenol, 4,4'-isopropylidenediphenol(bisphenol A), 2,2'-methylene-bis(4-chlorophenol), hydroquinone, 4,4'-cyclohexylidene-diphenol, novolak phenol resin and other phenol polymers.

Typical aromatic carboxylic acids which can be used as acceptor are:

aromatic carboxylic acids, for example, benzoic acid, p-tert-butylbenzoic acid, trichlorobenzoic acid, terephthalic acid, 3-sec-butyl-4-hydroxybenzoic acid, 3-cyclohexyl-4-hydroxybenzoic acid, 3,5-dimethyl-4-hydroxybenzoic acid, salicylic acid, 3-isopropyl-salicylic acid, 3-tert-butylsalicylic acid, 3-benzylsalicylic acid, 3-(α-methylbenzyl)salicylic acid, 3-chloro-5-(α-methylbenzyl)salicylic acid, 3,5-di-tert-butylsalicylic acid, 3,5-di-α-methylbenzylsalicylic acid, 3-phenyl-5-α, α-dimethylbenzylsalicylic acid.

Polymers of the above mentioned aromatic carboxylic acids with aldehydes or acetylene are also useful.

In addition, various polyvalent metal salts of the above mentioned phenolic compounds and aromatic carboxylic acids (including their polymers with aldehydes or acetylene) are also useful as acceptor. Among the polyvalent metals which can form such metallic salts like this there are included magnesium, aluminum, calcium, titanium, chromium, manganese, iron, cobalt, nickel, copper, zinc, silver, cadmium, tin and barium. Preferred metals are zinc, magnesium, aluminum and calcium.

Among useful inorganic acceptors there may be included activated clay, acid clay, attapulgite, bentonite, colloidal silica, aluminum silicate, magnesium silicate, zinc silicate, tin silicate, calcined kaolin and talc.

The above enumerated acceptors may be used either solely or in combination.

Generally, in the color developing layer of a heat-sensitive record material the amount of the acceptor is larger than the amount of the colorless chromogenic material. Usually, the amount of the acceptor is within the range of 1 to 50 parts by weight, preferably 4 to 10 parts by weight, per one part by weight of colorless chromogenic material.

The color developing layer including finely divided particles of colorless chromogenic material and finely divided particles of acceptor may be formed by coating a suitable base sheet either by a single step coating with a single coating composition in which colorless chromogenic material particles and acceptor particles are dispersed or by a two step coating with two coating compositions in colorless chromogenic material particles and acceptor particles are respectively dispersed. In the coating composition a binder such as starch, modified starch, hydroxyethyl cellulose, methyl cellulose, carboxymethylcellulose, gelatin, casein, gum arabic, polyvinyl alcohol, salts of styrene-maleic anhydride copolymer, styrene-butadiene copolymer emulsion, vinylacetate-maleic anhydride copolymer emulsion, salts of polyacrylicacid is used in an amount of 10 to 40% by weight, preferably 15 to 30% by weight with respect to the total solid amount.

In the coating composition various agents and additives may also be used. For example, in order to improve the color developing ability, enhance the light resistance and obtain matting effect inorganic metal compounds such as zinc oxide, magnesium oxide, calcium oxide, barium oxide, aluminum oxide, tin oxide, magnesium hydroxide, aluminum hydroxide, calcium hydroxide, zinc hydroxide, tin hydroxide, magnesium carbonate, zinc carbonate, calcium carbonate and inorganic pigments such as kaolin, clay, barium sulfate, zinc sulfide may be added in an amount of 0.1 to 5 parts by weight, preferably 0.2 to 2 parts by weight per one part of the acceptor used.

Further dispersing agents such as sodium dioctylsulfosuccinate, sodium dodecylbenzenesulfonate, sodium laurylalcoholsulfuric acid ester and metal salts of fatty acid, ultraviolet ray absorbing agents such as benzophenone derivatives and triazol derivatives, defoaming agents such as those of ester, ether, alcohol and silicon types, fluorescent dyes, coloring dyes may also be added to the coating composition. The coating composition may also contain dispersion or emulsion including stearic acid polyethylene, carnauba wax, paraffin wax, zinc stearate, calcium stearate, ester wax in order to prevent the heat-sensitive record material from being stuck in contact with stylus of a recording head.

The color developing layer of the heat-sensitive record material according to the invention may also include a certain, relatively small amount of the colorless chromogenic material in a crystalline state in addition to the colorless chromogenic material in an amorphous state.

The base sheet may be any of known types. The typical sheet material would be papers, plastic films and synthetic papers. If the base sheet is transparent the recorded sheet may be used as the second copying master. The amount of the coating composition for forming the color developing layer is not particularly limited but usually it would be within the range of 1 to 20 g/m$^2$ preferably 2 to 11 g/m$^2$ on dry basis.

DETAILED DESCRIPTION OF THE PREFERRED EMBODIMENT

The following examples serve to illustrate the invention in more detail although the invention is not limited to the examples. Unless otherwise indicated, parts and % signify parts by weight and % by weight, respectively.

EXAMPLE 1

The mixture of 25 parts of 2-phenylamino-3-methyl-6-(N-ethyl-N-p-toluidino)fluoran (LDK-1003 manufactured by Yamada Kagaku Kabushiki Kaisha, Japan) and 25 parts of 3-(N-cyclohexyl-N-methylamino)-6-methyl-7-phenylaminofluoran (PSD-150 manufactured by Shinnisso Kako Kabushiki Kaisha, Japan), which were crystalline colorless dyes, were heated at 180° C. to prepare a homogeneous salt. The melt was cooled to obtain an amorphous colorless dye. The amorphous structure was determined by X-ray diffraction pattern. The obtained amorphous dye was roughly pulverized and mixed with 25 parts of 20% aqueous solution of polyvinyl alcohol and 125 parts of water. The mixture was passed through a sand grinder, and pulverization was continued until an average particle size of 2–3 microns to prepare a dye dispersion (A).

On the other hand 40 parts of 4,4'-cyclohexlidene diphenol (Antigen W manufactured Sumitomo Chemical Company Ltd., Japan) was mixed with 20 parts of 20% aqueous solution of polyvinyl alcohol and 140 parts of water. The mixture was passed through a sand grinder and pulverization was continued until an average particle size of 2–3 microns to prepare an acceptor dispersion (a).

Further, 150 parts of natural ground calcium carbonate (Soften 1800 manufactured by Bihoku Funka Kabushiki Kaisha, Japan) was dispersed in 600 parts of 20% aqueous solution of polyvinyl alcohol to prepare a pigment dispersion.

Thus obtained dispersions were mixed in the following ratio to prepare a heat-sensitive coating composition.

Dye dispersion (A): 40 parts
Acceptor dispersion (a): 100 parts
Pigment dispersion: 75 parts The obtained coating composition was diluted with water until the solid content was 20%. The resultant composition was coated on a base sheet of 49 g/m$^2$ in the weight of an amount of 4 g/m$^2$ on dry basis. The coated material was dried and super-calendered to obtain a heat-sensitive record material.

Control 1

Example 1 was repeated except that 25 parts of 2-phenylamino-3-methyl-6-(N-ethyl-N-p-toludino)fluoran (LDK-1003) and 25 parts of 3-(N-cyclohexyl-N-methylamino)-6-methyl-7-phenylaminofluoran (PSD-150), which were crystalline dyes, were used instead of armorphous dye.

EXAMPLE 2

The mixture of 50 parts of 3-(N-cyclohexyl-N-methylamino)-6-methyl-7-phenylaminofluoran (PSD-150) and 10 parts of 1,3,3-trimethyl-1-phenylindane (Mitsui Petrochemical Industries Ltd., Japan), which were crystalline colorless dyes, was heated at 160° C. to obtain a homogenious melt. The melt was cooled to obtain an amorphous colorless dye. The amorphous structure was determined by X-ray diffraction pattern. The obtained amorphous dye was roughly pulverized and mixed with 30 parts of 20% aqueous solution of polyvinyl alcohol and 110 parts of water. The mixture was passed through a sand grinder, and pulverization was continued until an average particle size of 2–3 microns to prepare a dye dispersion (B).

A heat-sensitive record material was prepared in the same manner as in Example 1 except that the above dye dispersion (B) was used instead of dye dispersion (A).

CONTROL 2

50 Parts of 3-(N-cyclohexyl-N-methylamino)-6-methyl-7-phenylaminofluoran (PSD-150), which was a crystalline dye, was mixed with 25 parts of 20% aqueous solution of polyvinyl alcohol and 125 parts of water. The mixture was passed through a sand grinder. The pulverization was continued until an average particle size of 2–3 microns to prepare a dye dispersion (C).

A heat-sensitive record material was prepared in the same manner as in Example 2 except that the above dye dispersion (C) was used instead of dye dispersion (B).

EXAMPLE 3

20 parts of 4,4'-cyclohexylidenediphenol (Antigen W manufactured by Sumitomo Chemical Company, Ltd., Japan) and 20 parts of stearic acid amide were mixed with 20 parts of 20% aqueous solution of polyvinyl alcohol and 100 parts of water. The mixture was passed through a sand grinder. The pulverization was continued until an average particle size of 2–3 microns to prepare an acceptor dispersion (b).

A heat-sensitive record material was prepared in the same manner as in Example 2 except that the above acceptor dispersion (b) was used instead of acceptor dispersion (a).

CONTROL 3

A heat-sensitive record material was prepared in the same manner as in Example 3 except that dye dispersion (C) was used instead of dye dispersion (B).

EXAMPLE 4

A heat-sensitive record material was prepared in the same manner as in Example 3 except that 20 parts of 4,4'-isopropylidenediphenol (bisphenol A) was used instead of 4,4'-cyclohexylidenediphenol.

CONTROL 4

A heat-sensitive record material was prepared in the same manner as in Example 4 except that dye dispersion (C) was used instead of dye dispersion (B).

EXAMPLE 5

21 parts of 2-phenylamino-3-methyl-6-(N-ethyl-N-p-toluidino)fluoran (LDK-1003) and 21 parts of 3-diethylamino-7-(o-chloroanilino)fluoran (TH-106 manufactured by Hodogaya Kagaku Kogyo Kabushiki Kaisha, Japan), which were crystalline colorless dyes, were mixed with 18 parts of diisopropylnaphthalene oil (KMC-113 manufactured by Kureha Kagaku Kogyo Kabushiki Kaisha, Japan). The mixture was heated at 160° C. to obtain a homogeneous melt.

On the other hand, 60 parts of 20% aqueous solution of polyvinyl alcohol was mixed with 80 parts of water. The resultant solution was heated at 90° C. and the above melt was added and dispersed in the solution with stirring by a mixer. Then the aqueous system was heated at 90°-95° C., further stirred until a dispersion having a particle size of 2-3 microns was obtained, and cooled to prepare a dye dispersion (D).

A heat-sensitive record material was prepared in the same manner as in Example 1 except that 47.6 parts of the above dye dispersion (D) was used instead of 40 parts of dye dispersion (A).

CONTROL 5

21 Parts of 2-phenylamino-3-methyl-6-(N-ethyl-N-p-toluidino)fluoran (LDK-1003) and 21 parts of 3-diethylamino-7-(o-chloroanilino)fluoran (TH-106), which were crystalline colorless dyes, were mixed with 42 parts of 20% aqueous solution of polyvinyl alcohol and 116 parts of water. The mixture was passed through a sand grinder until a particle size of 2-3 microns to prepare a dye dispersion (E).

A heat-sensitive record material was prepared in the same manner as in Example 5 except that the above dye dispersion (E) was used instead of dye dispersion (D).

In order to determine the heat sensitivity of thus obtained ten heat-sensitive record materials, the heat-sensitive record materials were pressed with a pressure of 4 Kg/cm$^2$ for 5 seconds on a plate heated at selected temperatures to develop color images. The color density of the image was measured with Macbeth densitometer RD-100 R (manufactured by Macbeth Corporation, USA). The obtained results are shown in Table 1. As shown in Table 1, the heat-sensitive record materials prepared in Examples according to the invention have a higher heat-sensitivity than those prepared in controls.

TABLE 1

| | Applied temperature | | | | |
|---|---|---|---|---|---|
| Color Density | 60° C. | 80° C. | 100° C. | 120° C. | 140° C. |
| Example 1 | 0.15 | 0.72 | 0.95 | 1.01 | 1.05 |
| Control 1 | 0.14 | 0.51 | 0.80 | 0.94 | 0.99 |
| Example 2 | 0.15 | 0.20 | 0.46 | 0.73 | 0.90 |
| Control 2 | 0.15 | 0.16 | 0.27 | 0.30 | 0.68 |
| Example 3 | 0.19 | 0.86 | 1.02 | 1.10 | 1.13 |
| Control 3 | 0.16 | 0.50 | 0.72 | 0.91 | 1.03 |
| Example 4 | 0.26 | 1.04 | 1.06 | 1.09 | 1.11 |
| Control 4 | 0.23 | 0.70 | 0.85 | 1.00 | 1.02 |
| Example 5 | 0.33 | 1.11 | 1.11 | 1.13 | 1.13 |
| Control 5 | 0.12 | 0.62 | 0.86 | 1.04 | 1.03 |

What we claim is:

1. In a heat-sensitive record material comprising a base sheet having a color developing layer which includes finely divided particles comprising colorless chromogenic material and finely divided particles comprising acceptor which is reactive with said colorless chromogenic material to develop a color, the improvement that said colorless chromogenic material exists in said color developing layer in an amorphous state, said colorless chromogenic material in an amorphous state being one obtained by heating a colorless chromogenic material or colorless chromogenic composition which comprises at least one colorless chromogenic material, in a crystalline state to form a melt and then cooling said melt.

2. A heat-sensitive record material as defined in claim 1, in which said colorless chromogenic material in an amorphous state is one obtained by heating at least two kinds of colorless chromogenic materials, at least one of which is of a crystalline state, to form a co-melt and then cooling said co-melt.

3. A heat-sensitive record material as defined in claim 1, in which said colorless chromogenic material in an amorphous state is one obtained by heating at least one kind of colorless chromogenic material in a crystalline state together with at least one organic compound, which is compatible with said colorless chromogenic material, to form a co-melt and then cooling said co-melt.

4. A heat-sensitive record material as defined in claim 3, in which said organic compound is a solvent which takes a liquid phase at a normal temperature and is capable of dissolving said colorless chromogenic material in a crystalline state therein when heated.

* * * * *